US011280528B2

(12) United States Patent
Higashiiue et al.

(10) Patent No.: US 11,280,528 B2
(45) Date of Patent: Mar. 22, 2022

(54) HEAT EXCHANGER, AND REFRIGERATION CYCLE APPARATUS

(71) Applicants: Mitsubishi Electric Corporation, Tokyo (JP); The University of Tokyo, Tokyo (JP)

(72) Inventors: Shinya Higashiiue, Tokyo (JP); Tsuyoshi Maeda, Tokyo (JP); Akira Ishibashi, Tokyo (JP); Ryuichi Nagata, Tokyo (JP); Eiji Hihara, Tokyo (JP); Chaobin Dang, Tokyo (JP); Jiyang Li, Tokyo (JP)

(73) Assignees: Mitsubishi Electric Corporation, Tokyo (JP); The University of Tokyo, Tokyo (JP)

( * ) Notice: Subject to any disclaimer, the term of this patent is extended or adjusted under 35 U.S.C. 154(b) by 89 days.

(21) Appl. No.: 16/627,522

(22) PCT Filed: Aug. 3, 2017

(86) PCT No.: PCT/JP2017/028256
§ 371 (c)(1),
(2) Date: Dec. 30, 2019

(87) PCT Pub. No.: WO2019/026242
PCT Pub. Date: Feb. 7, 2019

(65) Prior Publication Data

US 2020/0166253 A1 May 28, 2020

(51) Int. Cl.
*F25B 39/02* (2006.01)
*F25B 41/00* (2021.01)
(Continued)

(52) U.S. Cl.
CPC ..... *F25B 39/028* (2013.01); *F25B 41/00* (2013.01); *F25B 39/04* (2013.01); *F25B 43/00* (2013.01);
(Continued)

(58) Field of Classification Search
CPC ..... F25B 39/028; F25B 41/00; F25B 39/04; F25B 43/00; F25B 2313/02741;
(Continued)

(56) References Cited

U.S. PATENT DOCUMENTS

2008/0302131 A1* 12/2008 Higashiyama ..... F28D 1/05391 62/515
2012/0180518 A1* 7/2012 Yukimoto ..... F25B 41/45 62/512
2019/0128577 A1* 5/2019 Sugimura ..... F25B 5/04

FOREIGN PATENT DOCUMENTS

JP H08-005195 A 1/1996
JP H10-267468 A 10/1998
JP 2005-300073 A 10/2005

OTHER PUBLICATIONS

International Search Report of the International Searching Authority dated Sep. 26, 2017 for the corresponding International application No. PCT/JP2017/028256 (and English translation).

* cited by examiner

*Primary Examiner* — Henry T Crenshaw
*Assistant Examiner* — Kamran Tavakoldavani
(74) *Attorney, Agent, or Firm* — Posz Law Group, PLC

(57) ABSTRACT

Provided is a heat exchanger, including: a refrigerant distributor including: a gas-liquid separating portion having a function of separating a gas-liquid refrigerant mixture into a liquid refrigerant and a gas refrigerant; and a distributing portion provided to the gas-liquid separating portion. A plurality of heat transfer pipes connected to the distributing
(Continued)

portion. The plurality of heat transfer pipes are arranged side by side in a first direction, and extend along a second direction intersecting with the first direction. When the refrigerant distributor is viewed along a direction orthogonal to each of the first direction and the second direction, a first space forming portion overlaps a region of the plurality of heat transfer pipes. When the refrigerant distributor and the heat transfer pipes are viewed along the first direction, a clearance is present between the gas-liquid separating portion and the heat transfer pipes.

8 Claims, 7 Drawing Sheets

(51) Int. Cl.
*F25B 39/04* (2006.01)
*F25B 43/00* (2006.01)
*F28D 21/00* (2006.01)
*F28F 9/02* (2006.01)

(52) U.S. Cl.
CPC ..... *F25B 2313/02741* (2013.01); *F25B 2400/23* (2013.01); *F25B 2500/01* (2013.01); *F28D 2021/0068* (2013.01); *F28F 9/02* (2013.01)

(58) Field of Classification Search
CPC ..... F25B 2400/23; F25B 2500/01; F25B 43/006; F25B 2400/16; F25B 39/02; F28D 2021/0068; F28F 9/02
See application file for complete search history.

HEAT EXCHANGER, AND REFRIGERATION CYCLE APPARATUS

CROSS REFERENCE TO RELATED APPLICATION

This application is a U.S. national stage application of PCT/JP2017/028256 filed on Aug. 3, 2017, the contents of which are incorporated herein by reference.

TECHNICAL FIELD

The present invention relates to a heat exchanger including a refrigerant distributor configured to distribute refrigerant to a plurality of heat transfer pipes, and a refrigeration cycle apparatus including the heat exchanger.

BACKGROUND ART

There has hitherto been known a heat exchanger having the following configuration for even distribution of refrigerant to a plurality of heat transfer pipes connected between a refrigerant inflow-side flow divider and a refrigerant outflow-side flow divider. Specifically, a gas-liquid refrigerant mixture is separated into a liquid refrigerant and a gas refrigerant by a gas-liquid separator and the liquid refrigerant is caused to flow into the refrigerant inflow-side flow divider from the gas-liquid separator through refrigerant pipes. In the related-art heat exchanger described above, heat is exchanged between the refrigerant and an air stream through passage of the air stream between the plurality of heat transfer pipes. When being viewed along a flow direction of the air stream, the gas-liquid separator is arranged at such a position as not to overlap the heat exchanger (see, for example, Patent Literature 1).

CITATION LIST

Patent Literature

[PTL 1] JP H8-5195 A

SUMMARY OF INVENTION

Technical Problem

In the related-art heat exchanger disclosed in Patent Literature 1, when being viewed along the flow direction of the air stream, the gas-liquid separator is arranged so as not to overlap a main body of the heat exchanger. Thus, a space for a whole unit including the heat exchanger and the gas-liquid separator is increased in the flow direction of the air stream. As a result, the whole unit including the gas-liquid separator and the heat exchanger is increased in size.

The present invention has been made to solve the problem described above, and has an object to provide a heat exchanger and a refrigerant cycle apparatus, to which a function of separating a gas-liquid refrigerant mixture into a liquid refrigerant and a gas refrigerant can be added while reduction in heat exchange efficiency and an increase in size are suppressed.

Solution to Problem

According to one embodiment of the present invention, there is provided a heat exchanger, including: a refrigerant distributor including, a gas-liquid separating portion having a function of separating a gas-liquid refrigerant mixture into a liquid refrigerant and a gas refrigerant, and a distributing portion provided to the gas-liquid separating portion; and a plurality of heat transfer pipes connected to the distributing portion, wherein the plurality of heat transfer pipes are arranged aide by side in a first direction, and extend along a second direction intersecting with the first direction, wherein, when the refrigerant distributor is viewed along a direction orthogonal to each of the first direction and the second direction, the gas-liquid separating portion overlaps a region of the plurality of heat transfer pipes, and wherein, when the refrigerant distributor and the heat transfer pipes are viewed along the first direction, a clearance is present between the gas-liquid separating portion and the heat transfer pipes.

Advantageous Effects of Invention

With the heat exchanger and the refrigeration cycle apparatus according to one embodiment of the present invention, the function of separating the gas-liquid refrigerant mixture into the liquid refrigerant and the gas refrigerant can be added to the refrigerant distributor while increase in size of the first header tank 2 is suppressed. Further, when the heat exchanger is viewed along the direction orthogonal to each of the first direction and the second direction, the gas-liquid separating portion can be located so that at least part thereof falls within a region in which the plurality of heat transfer pipes are arranged side by side. Thus, the increase in size of the heat exchanger can be suppressed. Further, an air stream can easily pass between the gas-liquid separating portion and the heat transfer pipes. As a result, reduction in heat transfer efficiency between the refrigerant flowing through the plurality of heat transfer pipes and the air stream can be suppressed.

DESCRIPTION OF EMBODIMENTS

Now, embodiments of the present invention are described with reference to the accompanying drawings.

First Embodiment

Figure 1:
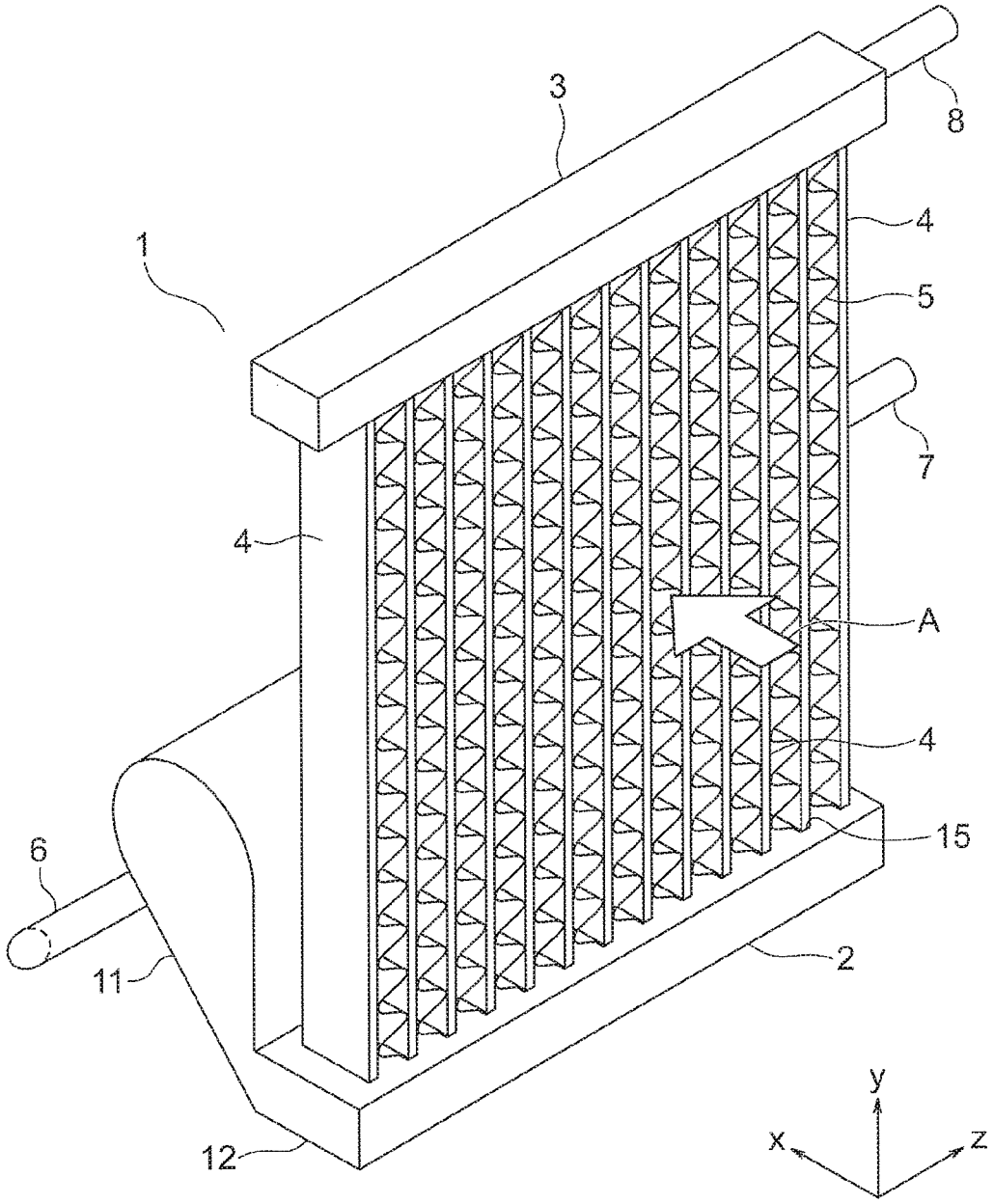
FIG. 1 is a perspective view for illustrating a heat exchanger according to a first embodiment of the present invention.

FIG. 1 is a perspective view for illustrating a heat exchanger according to a first embodiment of the present invention. In FIG. 1, a heat exchanger 1 includes a first header tank 2, a second header tank 3, a plurality of heat transfer pipes 4, and fins 5. The first header tank 2 serves as a refrigerant distributor. The second header tank 3 is arranged so as to be separated from the first header tank 2. The plurality of heat transfer pipes 4 couple the first header tank 2 and the second header tank 3 to each other. The fins 5 are provided between the plurality of heat transfer pipes 4. The heat exchanger 1 functions as an evaporator in a refrigeration cycle apparatus through which refrigerant circulates.

The first header tank 2 and the second header tank 3 are each hollow containers extending in parallel to each other along a first direction z. In this example, the heat exchanger 1 is arranged so that a longitudinal direction of the first header tank 2 and the second header tank 3, specifically, the first direction z matches with a horizontal direction. Further, in this example, the second header tank 3 is arranged above the first header tank 2.

The plurality of heat transfer pipes 4 are arranged side by side in the longitudinal direction of each of the first header tank 2 and the second header tank 3 so as to be spaced apart from each other. Further, the plurality of heat transfer pipes 4 extend in parallel to each other along a second direction y intersecting with the first direction z. In this example, the second direction y is orthogonal to the first direction z. Further, in this example, the heat exchanger 1 is arranged so that a longitudinal direction of each of the heat transfer pipes 4, specifically, the second direction y matches with a vertical direction.

Each of the heat transfer pipes 4 is a flat pipe. Thus, a sectional shape of each of the heat transfer pipes 4 when being cut along a plane orthogonal to the longitudinal direction of the heat transfer pipes 4 is a flat shape having a long axis and a short axis. When a long axis direction of a cross section of each of the heat transfer pipes 4 corresponds to a width direction of the heat transfer pipe 4 and a short axis direction of the cross section of each of the heat transfer pipes 4 corresponds to a thickness direction of the heat transfer pipe 4, the thickness direction of each of the heat transfer pipes 4 matches with the longitudinal direction of each of the first header tank 2 and the second header tank 3, specifically, the first direction z. Further, the width direction of each of the heat transfer pipes 4 matches with a third direction x intersecting with both of the first direction z and the second direction y. In this example, a direction orthogonal to both of the first direction z and the second direction y is defined as the third direction x. A plurality of refrigerant flow passages (not shown) through which refrigerant is caused to flow are provided inside each of the heat transfer pipes 4 along the longitudinal direction of the heat transfer pipes 4. The plurality of refrigerant flow passages are arranged side by side in the width direction of each of the heat transfer pipes 4.

Each of the fins 5 is connected to the heat transfer pipes 4 located on both sides of the fin 5. In this example, the fins 5 are corrugated fins. Thus, each of the fins 5 is a fin having a corrugated shape, which is brought into contact alternately with the heat transfer pipes 4 located on both sides of the corresponding fin 5.

In the heat exchanger 1, an air stream A, which is an air flow generated by an operation of a fan (not shown), passes between the plurality of heat transfer pipes 4. The air stream A flows while coming into contact with each surfaces of the heat transfer pipes 4 and the fins 5. With the flow of the air stream A, heat is exchanged between refrigerant flowing through the plurality of refrigerant flow passages and the air stream A. In this example, the air stream A passes between the plurality of heat transfer pipes 4 along the third direction x.

The first header tank 2 includes a first space forming portion 11, which is a gas-liquid separating portion, and a second space forming portion 12. The second space forming portion 12 is a distributing portion and is provided below the first space forming portion 11. With the configuration described above, the first space forming portion 11 and the second space forming portion 12 are integrated with each other. The first space forming portion 11 and the second space forming portion 12 extend along the longitudinal direction of the first header tank 2, specifically, the first direction z. The first header tank 2 is arranged so that a longitudinal direction of each of the first space forming portion 11 and the second space forming portion 12 matches with the horizontal direction.

A first refrigerant pipe 6 and a second refrigerant pipe 7 are connected to the first space forming portion 11. Further, a gas-liquid refrigerant mixture flows into the first space forming portion 11 through the first refrigerant pipe 6. A lower end portion of each of the heat transfer pipes 4 is inserted into the second space forming portion 12.

An upper end portion of each of the heat transfer pipes 4 is connected to the second header tank 3. The upper end portion of each of the heat transfer pipes 4 is inserted into the second header tank 3. With the insertion of the heat transfer pipes 4, the refrigerant flow passages of each of the heat transfer pipes 4 communicate with a space inside the second header tank 3. A third refrigerant pipe 8 is connected to an end of the second header tank 3 in the longitudinal direction. Although not shown, the second refrigerant pipe 7 is connected to the third refrigerant pipe 8.

Figure 2:
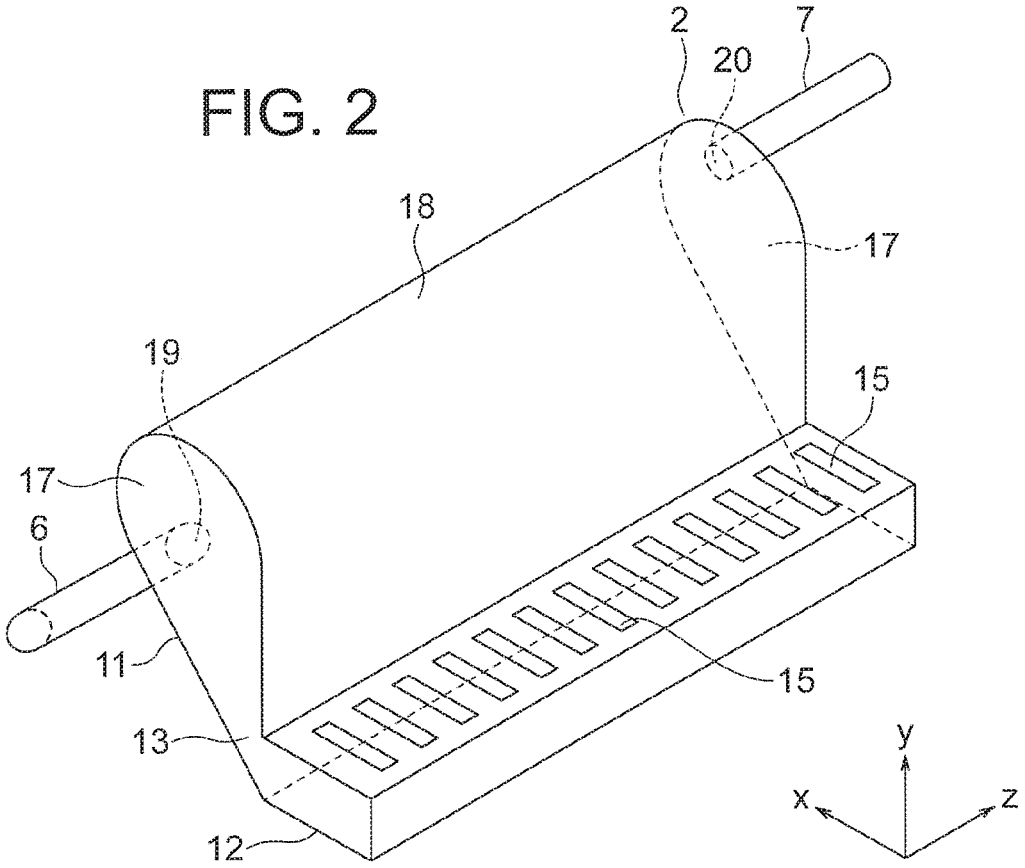
FIG. 2 is a perspective view for illustrating a first header tank of FIG. 1.
Figure 3:
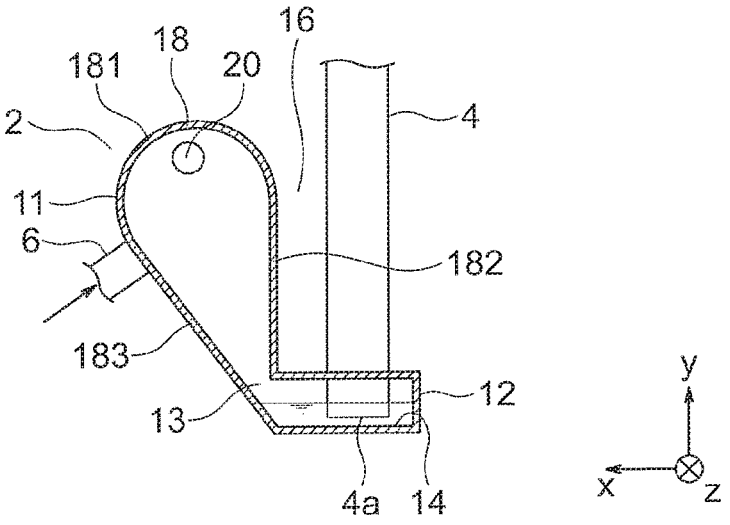
FIG. 3 is a sectional view for illustrating the first header tank when the heat exchanger is cut along a plane orthogonal to a longitudinal direction of the first header tank of FIG. 1.
Figure 4:
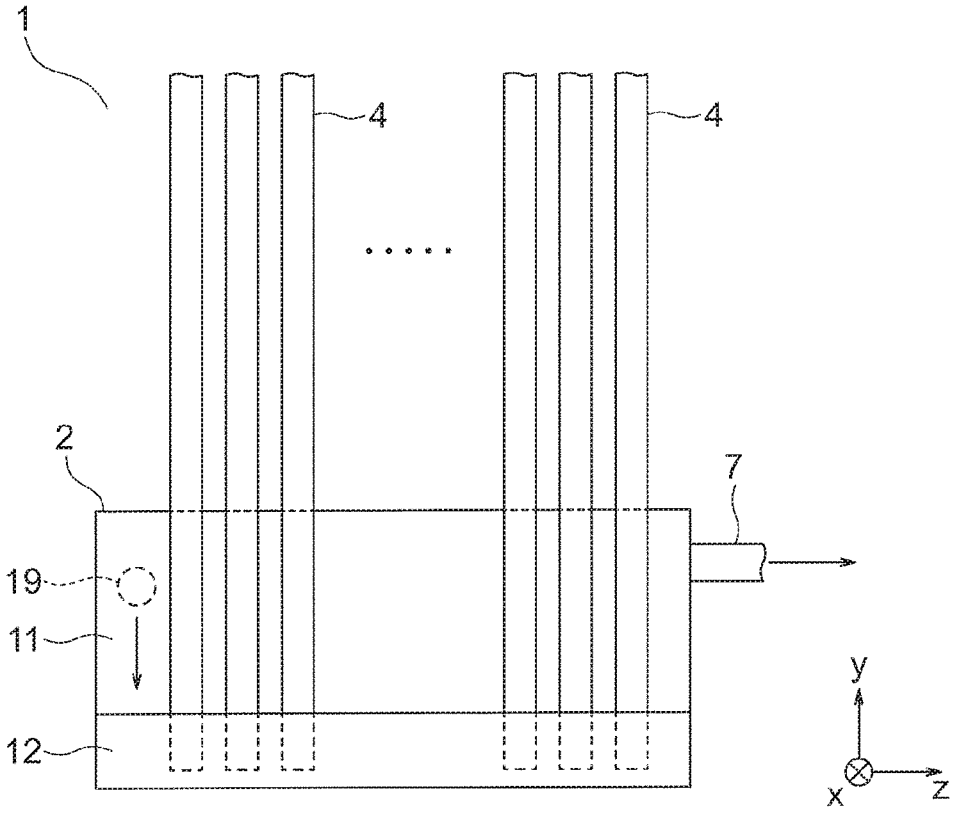
FIG. 4 is a front view for illustrating the first header tank when the heat exchanger is viewed along a direction orthogonal to both of a first direction z and a second direction y of FIG. 1.

FIG. 2 is a perspective view for illustrating the first header tank 2 of FIG. 1. Further, FIG. 3 is a sectional view for illustrating the first header tank 2 when being cut along a plane orthogonal to the longitudinal direction of the first header tank 2 of FIG. 1. Further, FIG. 4 is a front view for illustrating the first header tank 2 when being viewed along the direction orthogonal to both of the first direction z and the second direction y of FIG. 1.

A boundary portion between the first space forming portion 11 and the second space forming portion 12 serves as a flow contraction portion 13 configured to reduce a flow passage for the refrigerant in the first header tank 2. A space inside the first space forming portion 11 is brought into communication with a space inside the second space forming portion 12 through the flow contraction portion 13. When the first header tank 2 is viewed along the longitudinal direction of the first header tank 2, specifically, the first direction z, each of the space inside the first space forming portion 11 and the space inside the second space forming portion 12 has such a shape as to be reduced in a direction toward the flow contraction portion 13. Specifically, the space inside the first space forming portion 11 is reduced in a direction toward the second space forming portion 12, and the space inside the second space forming portion 12 is reduced in a direction toward the first space forming portion 11. Further, the space inside the first space forming portion 11 is larger than the space inside the second space forming portion 12.

When the second space forming portion 12 is viewed along the longitudinal direction of the first header tank 2, the second space forming portion 12 projects laterally from a lower part of the first space forming portion 11, as illustrated in FIG. 3. In this example, an upper surface of the second space forming portion 12 and an inner bottom surface 14 of the second space forming portion 12 lie horizontally.

The second space forming portion 12 has, as illustrated in FIG. 2, a plurality of insertion holes 15 serving as heat transfer pipe connecting portions. The plurality of insertion holes 15 are arranged side by side in the longitudinal direction of the second space forming portion 12, specifically, the first direction z so as to be spaced apart from each other. Further, the plurality of insertion holes 15 are formed in the upper surface of the second space forming portion 12.

The lower end portions of the heat transfer pipes 4 are inserted into the second space forming portion 12 through the insertion holes 15. Through the insertion, the refrigerant flow passages of each of the heat transfer pipes 4 communicate with the space inside the second space forming portion 12. Further, the lower end portions of the heat transfer pipes 4 are connected at positions of the insertion holes 15 formed in the second space forming portion 12. In this example, an end surface 4*a* of the lower end portion of each of the heat transfer pipes 4 is orthogonal to the longitudinal direction of each of the heat transfer pipes 4. As a result, in this example, the heat transfer pipes 4 are arranged along the vertical direction so that the end surfaces 4*a* of the lower end portions of the heat transfer pipes 4 are arranged horizontally. Further, in this example, the end surface 4*a* of the lower end portion of each of the plurality of heat transfer pipes 4 is separate from the inner bottom surface 14 of the second space forming portion 12.

When the heat exchanger 1 is viewed along the direction orthogonal to both of the first direction z and the second direction y, the first space forming portion 11 overlaps regions of the heat transfer pipes 4, as illustrated in FIG. 4. Further, when the first space forming portion 11 is viewed along the longitudinal direction of the first header tank 2, the first space forming portion 11 is arranged separately from the heat transfer pipes 4, as illustrated in FIG. 3. Specifically, when the heat exchanger 1 is viewed along the longitudinal direction of the first header tank 2, a clearance 16 is present between the first space forming portion 11 and the heat transfer pipes 4. In this example, the first space forming portion 11 is arranged on a downstream side of the air stream A, specifically, a leeward side with respect to the heat transfer pipes 4 so as to be separate from the heat transfer pipes 4.

When the first space forming portion 11 is viewed along the longitudinal direction of the first header tank 2, the first space forming portion 11 is continuously enlarged upward from the second space forming portion 12. The first space forming portion 11 includes, as illustrated in FIG. 2, a pair of end surface walls 17 and a peripheral wall 18. The pair of end surface walls 17 are formed at positions of both ends of the first header tank 2 in the longitudinal direction so as to be opposed to each other in the longitudinal direction of the first header tank 2. The peripheral wall 18 is formed between the pair of end surface walls 17 so as to surround a space between the pair of end surface walls 17 along outer peripheral edges of the pair of end surface walls 17. An inner surface and an outer surface of the first header tank 2 are formed of the pair of end surface walls 17 and the peripheral wall 18.

The peripheral wall 18 includes, as illustrated in FIG. 3, an upper-surface wall portion 181, a first side-surface wall portion 182, and a second side-surface wall portion 183. The upper-surface wall portion 181 forms an upper part of the first space forming portion 11. The first side-surface wall portion 182 connects an end of the upper-surface wall portion 181, which is located on a side closer to the heat transfer pipes 4, and the second space forming portion 11 to each other. The second side-surface wall portion 183 connects an end of the upper-surface wall portion 181, which is located on a side farther from the heat transfer pipes 4, and the second space forming portion 11 to each other.

In this example, the upper-surface wall portion 181 is curved so as to rise to an outside of the first space forming portion 11. With the shape described above, in this example, an outer shape of the upper part of the first space forming portion 11 when being viewed along the longitudinal direction of the first header tank 2 is a curved shape to rise to the outside of the first space forming portion 11. Further, in this example, when the peripheral wall 18 is viewed along the longitudinal direction of the first header tank 2, the first side-surface wall portion 182 is arranged along the longitudinal direction of the heat transfer pipes 4 and the second side-surface wall portion 183 is inclined with respect to the first side-surface wall portion 182.

The first space forming portion 11 has, as illustrated in FIG. 2, a first refrigerant port 19 and a second refrigerant port 20. An axis of the second refrigerant port 20 is offset from an axis of the first refrigerant port 19. Specifically, the first refrigerant port 19 and the second refrigerant port 20 are formed at positions, which are not located on the same axis. In this example, the first refrigerant port 19 is formed in the peripheral wall 18, and the second refrigerant port 20 is formed in one of the end surface walls 17.

The first refrigerant pipe 6 is connected to the first refrigerant port 19, and the second refrigerant pipe 7 is connected to the second refrigerant port 20. In this example, an axis of the first refrigerant pipe 6 matches with the axis of the first refrigerant port 19, and an axis of the second refrigerant pipe 7 matches with the axis of the second refrigerant port 20.

Next, an operation of the heat exchanger 1 is described. When the heat exchanger 1 functions as an evaporator, the gas-liquid refrigerant mixture flows from the first refrigerant pipe 6 through the first refrigerant port 19 into the space inside the first space forming portion 11. The gas-liquid refrigerant mixture, which has flowed into the space inside the first space forming portion 11 from the first refrigerant pipe 6, suddenly expands in the space inside the first space forming portion 11. As a result, a flow rate of the gas-liquid refrigerant mixture is decreased. At this time, a liquid refrigerant having a higher density moves downward by gravity, and passes through the flow contraction portion 13 to be accumulated in the space inside the second space forming portion 12. Meanwhile, a gas refrigerant having a lower density flows out from the second refrigerant port 20 into the second refrigerant pipe 7. As a result, the gas-liquid refrigerant mixture is separated into the liquid refrigerant and the gas refrigerant in the space inside the first space forming portion 11.

The liquid refrigerant accumulated in the space inside the second space forming portion 12 is evenly accumulated in the space inside the second space forming portion 12 in the longitudinal direction of the second space forming portion 12. When the liquid refrigerant is accumulated in the space inside the second space forming portion 12, the lower end portions of the heat transfer pipes 4 are immersed in the liquid refrigerant. After that, the liquid refrigerant accumulated in the space inside the second space forming portion 12 flows from the end surfaces 4*a* of the lower end portions of the heat transfer pipes 4 into the refrigerant flow passages and flows upward through the refrigerant flow passages toward the second header tank 3. At this time, the lower end portions of the heat transfer pipes 4 are immersed in the liquid refrigerant. Thus, the liquid refrigerant evenly flows into the refrigerant flow passages of each of the heat transfer pipes 4, and the liquid refrigerant is evenly distributed to the heat transfer pipes 4.

When the liquid refrigerant flows through the refrigerant flow passages of each of the heat transfer pipes 4, heat is exchanged between the air stream A passing between the plurality of heat transfer pipes 4 and the liquid refrigerant. With the heat exchange, heat is rejected from the liquid refrigerant to the air stream A, and the liquid refrigerant evaporates into a gas refrigerant.

The air stream A, which has passed between the plurality of heat transfer pipes 4, collides against the first space forming portion 11. The air stream A smoothly flows in the upper part of the first space forming portion 11 along the upper-surface wall portion 181 having a curved shape or passes through the clearance 16 between the first space forming portion 11 and the heat transfer pipes 4 to flow to both sides of the first space forming portion 11 in the longitudinal direction.

The gas refrigerant, which has phase-changed from the liquid into the gas in the heat transfer pipes 4, joins together in the space inside the second header tank 3, and flows out from the second header tank 3 to the third refrigerant pipe 8. After that, the gas refrigerant, which has flowed from the second header tank 3 into the third refrigerant pipe 8, joins the gas refrigerant, which has flowed out from the second refrigerant port 20 of the first space forming portion 11 into the second refrigerant pipe 7. When the heat exchanger 1 functions as a condenser, the refrigerant flows in a direction opposite to the direction in which the refrigerant flows when the heat exchanger 1 functions as an evaporator.

In the heat exchanger 1 described above, when the first header tank 2 is viewed along the direction orthogonal to each of the first direction z and the second direction y, the first space forming portion 11, which is the gas-liquid separating portion, overlaps a region of the plurality of heat transfer pipes 4. When the first header tank 2 and the heat transfer pipes 4 are viewed along the first direction z, the clearance 16 is present between the first space forming portion 11 and the heat transfer pipes 4. Thus, the first space forming portion 2 and the second space forming portion 12 can be integrated with each other. Hence, a function of separating the gas-liquid refrigerant mixture into the liquid refrigerant and the gas refrigerant can be added to the first header tank 2 while an increase in size of the first header tank 2 is suppressed. Further, even after the function of separating the gas-liquid refrigerant mixture into the liquid refrigerant and the gas refrigerant is added to the first header tank 2, when the first header tank 2 is viewed along the direction orthogonal to each of the first direction z and the second direction y, the first space forming portion 11 can be located so that at least part thereof falls within a region in which the plurality of heat transfer pipes 4 are arranged side by side. Thus, the increase in size of the heat exchanger 1 can be suppressed. Further, owing to the presence of the clearance 16 between the first space forming portion 11 and the heat transfer pipes 4, the air stream A can easily pass between the first space forming portion 11 and the heat transfer pipes 4. As a result, promotion of the heat exchange between the refrigerant flowing through the plurality of heat transfer pipes 4 and the air stream A can be achieved, and hence reduction in heat exchange efficiency between the refrigerant and the air stream A can be suppressed.

Further, the first space forming portion 11 is arranged on the leeward side of the plurality of heat transfer pipes 4. Thus, the air stream A can pass between the plurality of heat transfer pipes 4 under a state in which a temperature difference between the air stream A and the heat transfer pipes 4 is large. As a result, the heat exchange efficiency between the refrigerant flowing through the heat transfer pipes 4 and the air stream A can be improved.

Further, an outer shape of the upper part of the first space forming portion 11 when being viewed along the first direction z is a curved shape. Hence, the air stream A can smoothly flow along the outer shape of the first space forming portion 11, and a resistance, which may be given to the air stream A from the first space forming portion 11, can be suppressed. As a result, the air stream A can effectively pass between the plurality of heat transfer pipes 4, and hence the heat exchange efficiency between the refrigerant flowing through the heat transfer pipes 4 and the air stream A can be further improved.

Further, the axis of the first refrigerant port 19 is offset from the axis of the second refrigerant port 20. Thus, an orientation of flow of the gas-liquid refrigerant mixture flowing into the space inside the first space forming portion 11 through the first refrigerant port 19 can be changed in the space inside the first space forming portion 11. In this manner, the gas-liquid refrigerant mixture can easily be separated into the liquid refrigerant and the gas refrigerant.

Further, the plurality of insertion holes 15 are arranged side by side in the longitudinal direction of the second space forming portion 12, and the first header tank 2 is arranged so that the longitudinal direction of the second space forming portion 12 matches with the horizontal direction. Thus, the liquid refrigerant can be evenly accumulated in the space inside the second space forming portion 12 over the entire region in the longitudinal direction of the second space forming portion 12. In this manner, the liquid refrigerant to the plurality of heat transfer pipes 4 can be more reliably evenly distributed.

Further, the lower end portions of the plurality of heat transfer pipes 4 are connected to the second space forming portion 12. Thus, the first space forming portion 12 projecting upward from the second space forming portion 12 can be located so as to fall within the region of the heat transfer pipes 4 in the second direction y. As a result, a dimension of the heat exchanger 1 in a height direction can be prevented from being increased.

Further, the space inside the first space forming portion 11 becomes smaller toward the second space forming portion 12. Thus, the liquid refrigerant accumulated in the space inside the second space forming portion 12 becomes less liable to flow back into the space inside the first space forming portion 11. In this manner, the separation of the gas-liquid refrigerant mixture into the liquid refrigerant and the gas refrigerant can be further ensured.

Second Embodiment

Figure 5:
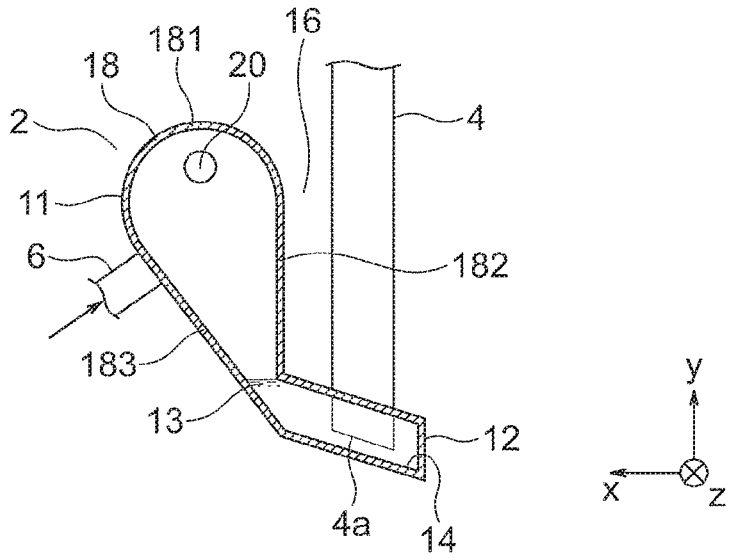
FIG. 5 is a sectional view for illustrating a main part of a heat exchanger according to a second embodiment of the present invention.

FIG. 5 is a sectional view for illustrating a main part of the heat exchanger 1 according to a second embodiment of the present invention. FIG. 5 corresponds to FIG. 3 of the first embodiment. In this embodiment, when the first header tank 2 is viewed along the longitudinal direction of the first header tank 2, specifically, the first direction z, the upper surface of the second space forming portion 12 and the inner bottom surface 14 of the second space forming portion 12 are inclined with respect to a horizontal plane. Further, when the first header tank 2 is viewed along the first direction z, the upper surface of the second space forming portion 12 and the inner bottom surface 14 of the second space forming portion 12 are inclined obliquely downward from the lower part of the first space forming portion 11. In this example, the upper surface of the second space forming portion 12 and the inner bottom surface 14 of the second space forming portion 12 are inclined obliquely downward from the lower part of the first space forming portion 11 toward a windward side.

The end surface 4*a* of the lower end portion of each of the heat transfer pipes 4 is inclined with respect to the horizontal plane. In this example, the end surface 4*a* of the lower end portion of each of the heat transfer pipes 4 is inclined in the same direction as that of inclination of the inner bottom surface 14 with respect to the horizontal plane. Thus, in this example, the end surface 4*a* of the lower end portion of each of the heat transfer pipes 4 is inclined downward from the leeward side to the windward side of the heat transfer pipes 4. Other configurations and operation are the same as those of the first embodiment.

In the heat exchanger 1 described above, the inner bottom surface 14 of the second space forming portion 12 is inclined with respect to the horizontal plane. Thus, even when the amount of liquid refrigerant accumulated in the space inside the second space forming portion 12 is small, a depth of the liquid refrigerant can easily be secured. In this manner, the lower end portions of the heat transfer pipes 4 are more likely to be immersed in the liquid refrigerant. Thus, the liquid refrigerant accumulated in the space inside the second space forming portion 12 can more reliably flow into the heat transfer pipes 4.

Further, the end surface 4*a* of the lower end portion of each of the heat transfer pipes 4 is inclined with respect to the horizontal plane. Thus, even when the amount of liquid refrigerant accumulated in the space inside the second space forming portion 12 is small, an inclined lower end portion of the end surface 4*a* of each of the heat transfer pipes 4 can easily be immersed in the liquid refrigerant. With this, the liquid refrigerant can more actively flow into the refrigerant flow passages located on the side closer to the inclined lower end portion of the end surface 4*a* than into the refrigerant flow passages located on the side closer to an inclined upper end portion of the end surface 4*a* in the heat transfer pipes 4. Thus, for example, by inclining the end surface 4*a* of the lower end portion of the heat transfer pipes 4 downward from the leeward side of the heat transfer pipes 4 to the windward side, the liquid refrigerant can actively flow into the refrigerant flow passages located on the windward side of the heat transfer pipes 4. Thus, efficiency of heat exchange between the air stream A and the liquid refrigerant can be improved.

In the example described above, both of the inner bottom surface 14 of the second space forming portion 12 and the end surface 4*a* of the lower end portion of each of the heat transfer pipes 4 are inclined with respect to the horizontal plane. However, the inner bottom surface 14 of the second space forming portion 12 may be arranged horizontally, and the end surface 4*a* of the lower end portion of each of the heat transfer pipes 4 may be inclined with respect to the horizontal plane. Alternatively, the end surface 4*a* of the lower end portion of each of the heat transfer pipes 4 may be arranged horizontally, and the inner bottom surface 14 of the second space forming portion 12 may be inclined with respect to the horizontal plane.

Further, in the first embodiment and the second embodiment, the first refrigerant port 19 is formed in the peripheral wall 18 of the first space forming portion 11, and the second refrigerant port 20 is formed in the end surface wall 17 of the first space forming portion 11. However, positions of the first refrigerant port 19 and the second refrigerant port 20, which are formed in the first space forming portion 11, are not limited to those described above. For example, both of the first refrigerant port 19 and the second refrigerant port 20 may be formed in the peripheral wall 18, or the first refrigerant port 19 may be formed in one of the end surface walls 17 and the second refrigerant port 20 may be formed in another one of the end surface walls 17.

Figure 6:
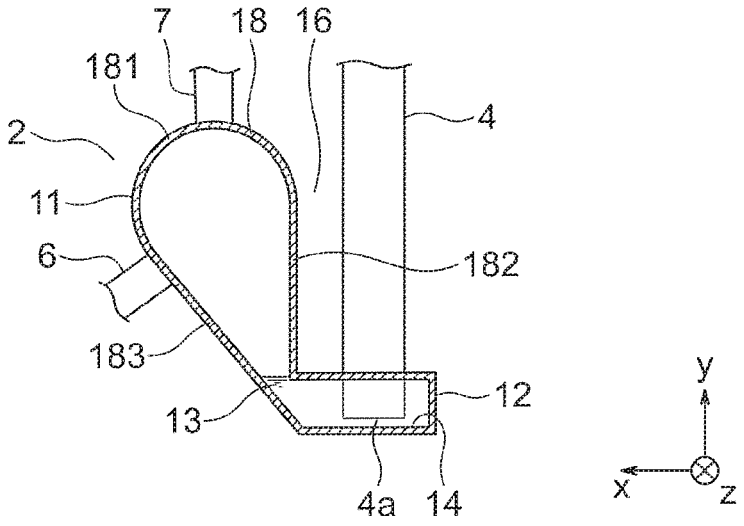
FIG. 6 is a sectional view for illustrating another example of the first header tank of the heat exchanger according to the first embodiment of the present invention.

Further, when both of the first refrigerant port 19 and the second refrigerant port 20 are formed in the peripheral wall 18, the first refrigerant port 19 may be formed in the second side-surface wall portion 183 of the peripheral wall 18 and the second refrigerant port 20 may be formed in the upper-surface wall portion 181 of the peripheral wall 18. In this case, taking the first header tank 2 in the first embodiment as an example, as illustrated in FIG. 6, the second refrigerant pipe 7 is arranged so as to extend upward from the upper-surface wall portion 181 of the first space forming portion 11. With the arrangement described above, the gas refrigerant in the first space forming portion 11 can easily flow out through the second refrigerant port 20.

Further, in the first embodiment and the second embodiment, the axis of the second refrigerant port 20 is offset from the axis of the first refrigerant port 19. However, the axis of the second refrigerant port 20 may match with the axis of the first refrigerant port 19 as long as a distance between the first refrigerant port 19 and the second refrigerant port 20 is secured to such an extent that the gas-liquid refrigerant mixture, which has flowed from the first refrigerant port 19 into the space inside the first space forming portion 11, does not directly flow out through the second refrigerant port 20.

Third Embodiment

Figure 7:
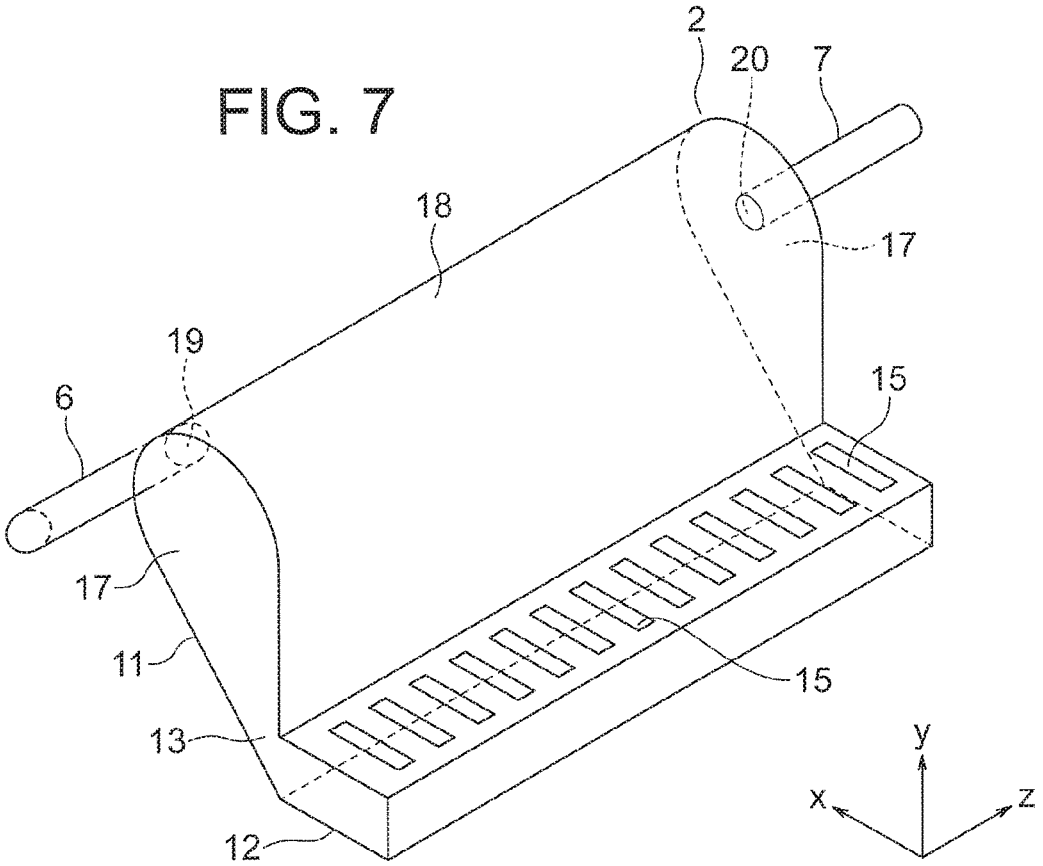
FIG. 7 is a perspective view for illustrating a first header tank of a heat exchanger according to a third embodiment of the present invention.
Figure 8:
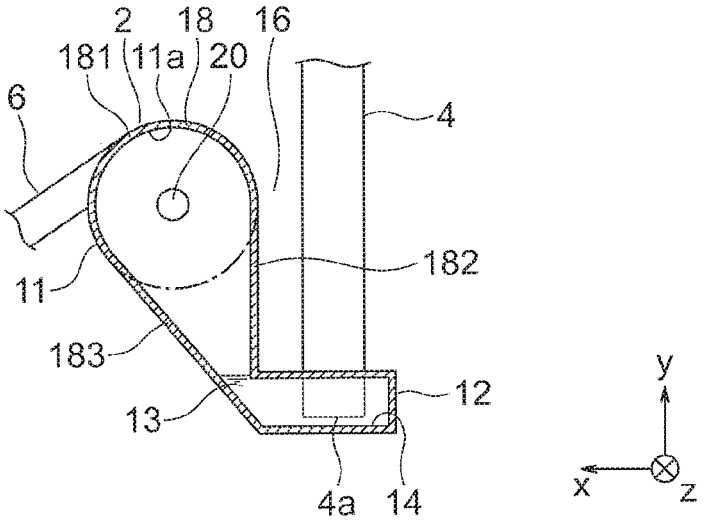
FIG. 8 is a sectional view for illustrating the first header tank when the heat exchanger is cut along a plane orthogonal to a longitudinal direction of the first header tank of FIG. 7.

FIG. 7 is a perspective view for illustrating the first header tank 2 of the heat exchanger 1 according to a third embodiment. FIG. 8 is a sectional view for illustrating the first header tank 2 when the heat exchanger 1 is cut along a plane orthogonal to the longitudinal direction of the first header tank 2 of FIG. 7. In this embodiment, the positions of the first refrigerant port 19 and the second refrigerant port 20 are different from those in the first embodiment and the second embodiment.

The first refrigerant port 19 is formed in the upper-surface wall portion 181 of the first space forming portion 11. An inner surface of the first space forming portion 11 includes a curved surface 11*a* formed by curvature of the upper-surface wall portion 181. The curved surface 11*a* is continuous from the first refrigerant port 19. In this example, when being viewed along the longitudinal direction of the first header tank 2, the curved surface 11*a* forms an arc.

The first refrigerant pipe 6 connected to the first refrigerant port 19 is arranged along a tangent line of the curved surface 11*a* at the first refrigerant port 19. With the arrangement described above, the first refrigerant pipe 6 guides the refrigerant so that the refrigerant flows into the space inside the first space forming portion 11 in a direction along the tangent line of the curved surface 11*a*.

The second refrigerant port 20 is formed in one of the end surface walls 17. Further, when being viewed along the longitudinal direction of the first header tank 2, the second refrigerant port 20 is located at a center of the arc formed of the curved surface 11*a*. Other configurations are the same as those of the first embodiment.

Next, an operation of the heat exchanger 1 is described. The gas-liquid refrigerant mixture guided into the first refrigerant pipe 6 flows into the space inside the first space forming portion 11 in a direction along the tangent line of the curved surface 11*a*. With the flow, the gas-liquid refrigerant mixture flows along the curved surface 11*a* inside the first space forming portion 11, and a centrifugal force acts on the gas-liquid refrigerant mixture.

When the centrifugal force acts on the gas-liquid refrigerant mixture, the liquid refrigerant having a higher density moves to an outer side, and the gas refrigerant having a lower density moves to an inner side toward a center. With the movement, the gas-liquid refrigerant mixture is separated into the liquid refrigerant and the gas refrigerant in the space inside the first space forming portion 11. After that, the gas refrigerant flows out through the second refrigerant port 20 into the second refrigerant pipe 7, and the liquid refrigerant is accumulated in the space inside the second space forming portion 12 by the centrifugal force and the gravity. A subsequent operation is the same as that in the first embodiment.

In the heat exchanger 1 described above, the first refrigerant pipe 6 connected to the first refrigerant port 19 is arranged along the tangent line of the curved surface 11*a* at the first refrigerant port 19. Thus, the gas-liquid refrigerant mixture can flow into the space inside the first space forming portion 11 in the direction along the tangent line of the curved surface 11*a*. With the flow described above, the gas-liquid refrigerant mixture, which has flowed into the space inside the first space forming portion 11, can flow along the curved surface 11*a*, and the centrifugal force can act on the gas-liquid refrigerant mixture. As a result, the liquid refrigerant having a higher density can be actively moved to the outer side with respect to the gas refrigerant having a lower density by the centrifugal force. Thus, the gas-liquid refrigerant mixture can be efficiently separated into the liquid refrigerant and the gas refrigerant.

Further, when being viewed along the longitudinal direction of the first header tank 2, the curved surface 11*a* of the inner surface of the first space forming portion 11 forms the arc, and the second refrigerant port 20 is located at the center of the arc of the curved surface 11*a*. Thus, the gas refrigerant, which is concentrated at the center on the inner side of the curved surface 11*a*, can efficiently flow out through the second refrigerant port 20 into the second refrigerant pipe 7.

In the example described above, the second space forming portion 12 is the same as that in the first embodiment. However, the second space forming portion 12 similar to that of the second embodiment, which is inclined with respect to the horizontal plane, may be applied to the second space forming portion 12 according to this embodiment.

Fourth Embodiment

Figure 9:
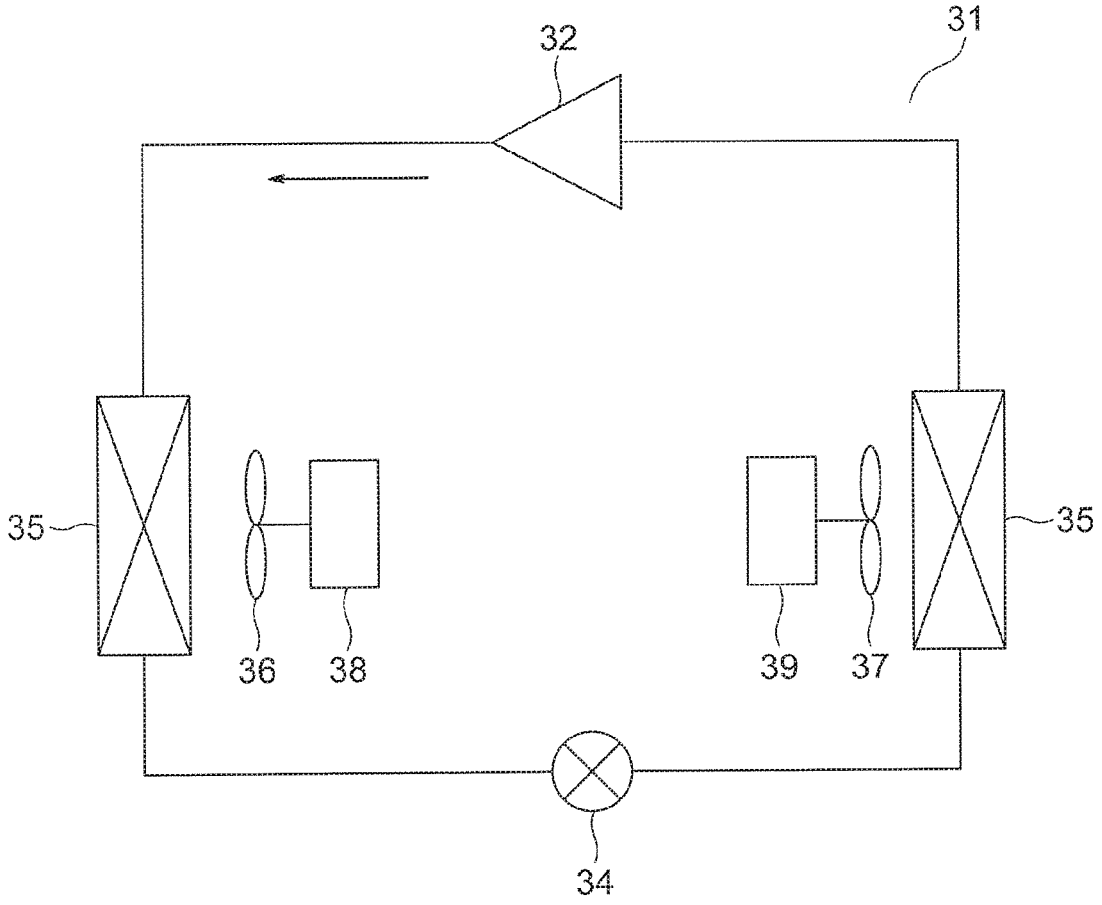
FIG. 9 is a configuration diagram for illustrating a refrigeration cycle apparatus according to a fourth embodiment of the present invention.

FIG. 9 is a configuration diagram for illustrating a refrigeration cycle apparatus according to a fourth embodiment of the present invention. A refrigeration cycle apparatus 31 includes a refrigeration cycle circuit including a compressor 32, a condensing heat exchanger 33, an expansion valve 34, and an evaporating heat exchanger 35. In the refrigeration cycle apparatus 31, a refrigeration cycle is carried out by drive of the compressor 32. In the refrigeration cycle, the refrigerant circulates through the compressor 32, the condensing heat exchanger 33, the expansion valve 34, and the evaporating heat exchanger 35 while changing a phase. In this embodiment, the refrigerant circulating through the refrigeration cycle circuit flows in a direction indicated by the arrow in FIG. 9.

The refrigeration cycle apparatus 31 includes fans 36 and 37 and drive motors 38 and 39. The fans 36 and 37 individually send air streams to the condensing heat exchanger 33 and the evaporating heat exchanger 35, respectively. The drive motors 38 and 39 are configured to individually rotate the fans 36 and 37, respectively. The condensing heat exchanger 33 exchanges heat between the air stream of an air generated by an operation of the fan 36 and the refrigerant. The evaporating heat exchanger 35 exchanges heat between the air stream of an air generated by an operation of the fan 37 and the refrigerant.

The refrigerant is compressed in the compressor 2 and is sent to the condensing heat exchanger 33. In the condensing heat exchanger 33, the refrigerant transfers heat to an outside air and condenses. After that, the refrigerant is sent to the expansion valve 34. After being decompressed by the expansion valve 34, the refrigerant is sent to the evaporating heat exchanger 35. After that, the refrigerant takes heat from the outside air in the evaporating heat exchanger 35 and evaporates. Then, the refrigerant returns to the compressor 32.

In this embodiment, the heat exchanger 1 according to any one of the first to fourth embodiments is used for one or both of the condensing heat exchanger 33 and the evaporating heat exchanger 35. With use of the heat exchanger 1, the refrigeration cycle apparatus having high energy efficiency can be achieved. Further, in this embodiment, the condensing heat exchanger 33 is used as an indoor heat exchanger, and the evaporating heat exchanger 35 is used as an outdoor heat exchanger. The evaporating heat exchanger 35 may be used as an indoor heat exchanger, and the condensing heat exchanger 33 may be used as an outdoor heat exchanger.

Fifth Embodiment

Figure 10:
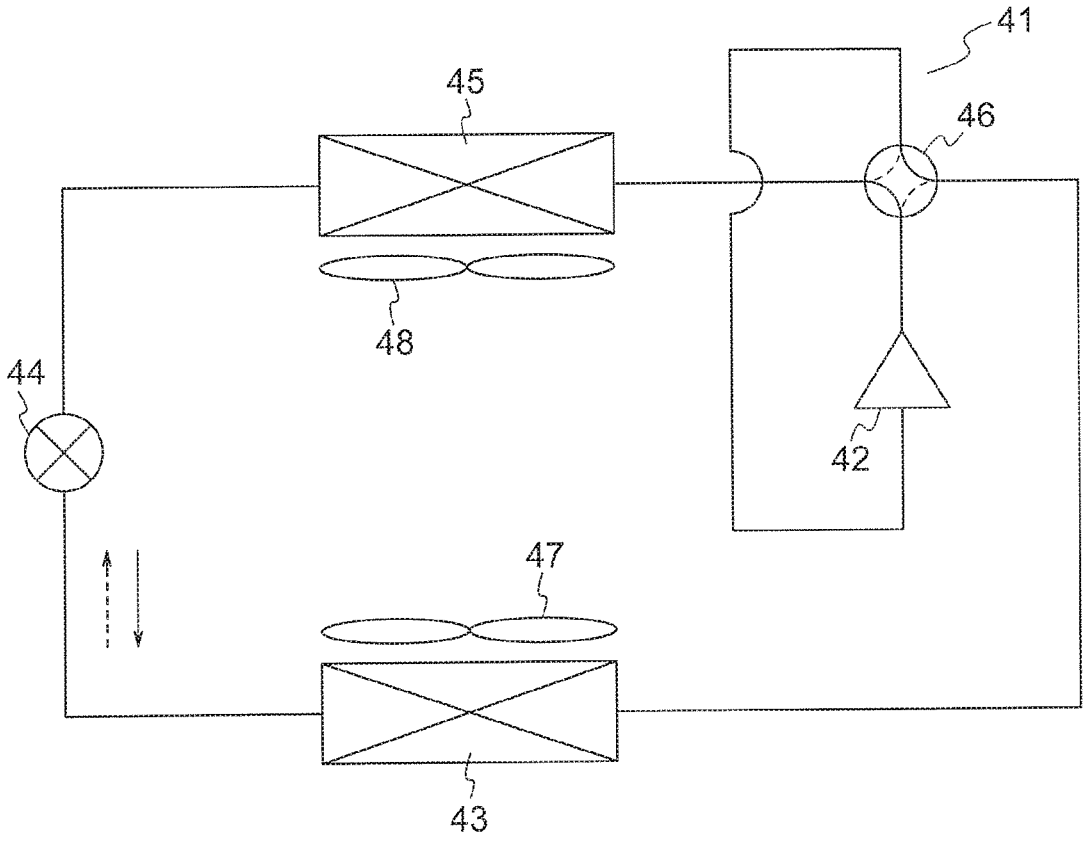
FIG. 10 is a configuration diagram for illustrating a refrigeration cycle apparatus according to a fifth embodiment of the present invention.

FIG. 10 is a configuration diagram for illustrating a refrigeration cycle apparatus according to a fifth embodiment of the present invention. A refrigeration cycle apparatus 41 includes a refrigeration cycle circuit including a compressor 42, an outdoor heat exchanger 43, an expansion valve 44, an indoor heat exchanger 45, and a four-way valve 46. In the refrigeration cycle apparatus 41, a refrigeration cycle is carried out by drive of the compressor 42. In the refrigeration cycle, the refrigerant circulates through the compressor 42, the outdoor heat exchanger 43, the expansion valve 44, and the indoor heat exchanger 45 while changing a phase. In this embodiment, the compressor 42, the outdoor heat exchanger 43, the expansion valve 44, and the four-way valve 46 are provided to an outdoor unit, and the indoor heat exchanger 45 is provided to an indoor unit.

An outdoor fan 47 configured to force the outdoor air to pass through the outdoor heat exchanger 43 is provided to the outdoor unit. The outdoor heat exchanger 43 exchanges heat between an air stream of the outdoor air, which is generated by an operation of the outdoor fan 47, and the refrigerant. An indoor fan 48 configured to force the indoor air to pass through the indoor heat exchanger 45 is provided to the indoor unit. The indoor heat exchanger 45 exchanges heat between an air stream of the indoor air, which is generated by an operation of the indoor fan 48, and the refrigerant.

An operation of the refrigeration cycle apparatus 41 can be switched between a cooling operation and a heating operation. The four-way valve 46 is an electromagnetic valve configured to switch a refrigerant flow passage in accordance with the switching of the operation of the refrigeration cycle apparatus 1 between the cooling operation and the heating operation. The four-way valve 46 guides the refrigerant from the compressor 42 to the outdoor heat exchanger 43 and the refrigerant from the indoor heat exchanger 45 to the compressor 42 during the cooling operation, and guides the refrigerant from the compressor 42 to the indoor heat exchanger 45 and the refrigerant from the outdoor heat exchanger 43 to the compressor 42 during the heating operation. In FIG. 10, a direction of flow of the refrigerant during the cooling operation is indicated by the broken-line arrow, and a direction of flow of the refrigerant during the heating operation is indicated by the solid-line arrow.

During the cooling operation of the refrigeration cycle apparatus 41, the refrigerant, which has been compressed in the compressor 42, is sent to the outdoor heat exchanger 43. In the outdoor heat exchanger 43, the refrigerant transfers heat to the outdoor air and condenses. After that, the refrigerant is sent to the expansion valve 44. After being decompressed by the expansion valve 44, the refrigerant is sent to the indoor heat exchanger 45. Then, after the refrigerant takes heat from an indoor air in the indoor heat exchanger 45 and evaporates, the refrigerant returns to the compressor 42. Thus, during the cooling operation of the refrigerant cycle device 41, the outdoor heat exchanger 43 functions as a condenser, and the indoor heat exchanger 45 functions as an evaporator.

During the heating operation of the refrigeration cycle apparatus 41, the refrigerant, which has been compressed in the compressor 42, is sent to the indoor heat exchanger 45. In the indoor heat exchanger 45, the refrigerant transfers heat to the indoor air and condenses. After that, the refrigerant is sent to the expansion valve 44. After being decompressed by the expansion valve 44, the refrigerant is sent to the outdoor heat exchanger 43. Then, after the refrigerant takes heat from an outdoor air in the outdoor heat exchanger 43 and evaporates, the refrigerant returns to the compressor 42. Thus, during the heating operation of the refrigerant cycle device 41, the outdoor heat exchanger 43 functions as an evaporator, and the indoor heat exchanger 45 functions as a condenser.

In this embodiment, the heat exchanger 1 according to the first to fourth embodiments is used for one or both of the outdoor heat exchanger 43 and the indoor heat exchanger 45. With use of the heat exchanger 1, the refrigeration cycle apparatus having high energy efficiency can be achieved.

The refrigeration cycle apparatus according to the fourth embodiment and the fifth embodiment is applied to, for example, an air conditioning apparatus or a refrigeration apparatus.

Further, in each of the embodiments described above, the first space forming portion 11 is arranged on the leeward side of the heat transfer pipes 4 so as to be separate from the heat transfer pipes 4. However, the first space forming portion 11 may be arranged on the windward side of the heat transfer pipes 4 so as to be separate from the heat transfer pipes 4. Even in the manner described above, the increase in size of the heat exchanger 1 when the first header tank 2 is viewed along the direction orthogonal to each of the first direction z and the second direction y can be suppressed. At the same time, the air stream A can easily pass between the first space forming portion 11 and the heat transfer pipes 4. As a result, the reduction in heat exchange efficiency between the refrigerant flowing through the heat transfer pipes 4 and the air stream A can be suppressed.

In each of the embodiments described above, the upper-surface wall portion 181 of the first space forming portion 11 is curved. However, a shape of the upper-surface wall portion 181 is not limited thereto. For example, the upper-surface wall portion 181 may be formed into a flat plate shape.

Further, in each of the embodiments described above, the first space forming portion 11 is formed over the entire first header tank 2 in the longitudinal direction of the first header tank 2. However, the first space forming portion 11 may be formed over only part of the first header tank 2 in the longitudinal direction of the first header tank 2. Specifically, a length of the first space forming portion 11 may be shorter than a length of the second space forming portion 12 in the longitudinal direction of the first header tank 2. Further, the second space forming portion 12 may be formed over only part of the first header tank 2 in the longitudinal direction of the first header tank 2. Specifically, a length of the second space forming portion 12 may be shorter than a length of the first space forming portion 11 in the longitudinal direction of the first header tank 2. Even in this manner, the reduction in size of the whole unit including the heat exchanger 1 can be achieved.

Further, in each of the embodiments described above, each of the heat transfer pipes 4 is a flat pipe. However, a sectional shape of each of the heat transfer pipes 4 is not limited to the flat shape. For example, each of the heat transfer pipes 4 may be a circular pipe.

Further, the present invention is not limited to the respective embodiments described above, and can be carried out with various changes within the scope of the present invention.

REFERENCE SIGNS LIST

1 heat exchanger, 2 first header tank (refrigerant distributor), 4 heat transfer pipe, 11 first space forming portion (gas-liquid separating portion), 12 second space forming portion (distributing portion), 19 first refrigerant port, 20 second refrigerant port, 31, 41 refrigeration cycle apparatus

The invention claimed is:

1. A heat exchanger, comprising:

a header tank including:

a gas-liquid separator having a function of separating a gas-liquid refrigerant mixture into a liquid refrigerant and a gas refrigerant; and a distributor provided to the gas-liquid separator; and a plurality of heat transfer pipes connected to the distributor, wherein the plurality of heat transfer pipes are arranged side by side in a first direction, and extend along a second direction intersecting with the first direction, wherein a space inside the gas-liquid separator is larger than a space inside the distributor, wherein the gas-liquid separator is enlarged upward from the distributor when being viewed along the first direction, wherein, when the header tank is viewed along a direction orthogonal to each of the first direction and the second direction, the gas-liquid separator overlaps a region of the plurality of heat transfer pipes, and wherein, when the header tank and the heat transfer pipes are viewed along the first direction, a clearance is present between the gas-liquid separator and the heat transfer pipes.

2. The heat exchanger according to claim 1, wherein the gas-liquid separator is arranged on a leeward side of the plurality of heat transfer pipes.

3. The heat exchanger according to claim 1, wherein the distributor is provided below the gas-liquid separator, and wherein an outer shape of an upper part of the gas-liquid separator when being viewed along the first direction is a curved shape.

4. A refrigeration cycle apparatus comprising a heat exchanger, the heat exchanger comprising:

a header tank including:

a gas-liquid separator having a function of separating a gas-liquid refrigerant mixture into a liquid refrigerant and a gas refrigerant; and a distributor provided to the gas-liquid separator; and a plurality of heat transfer pipes connected to the distributor, wherein the plurality of heat transfer pipes are arranged side by side in a first direction, and extend along a second direction intersecting with the first direction, wherein a space inside the gas-liquid separator is larger than a space inside the distributor, wherein the gas-liquid separator is enlarged upward from the distributor when being viewed along the first direction, wherein, when the header tank is viewed along a direction orthogonal to each of the first direction and the second direction, the gas-liquid separator overlaps a region of the plurality of heat transfer pipes, and wherein, when the header tank and the heat transfer pipes are viewed along the first direction, a clearance is present between the gas-liquid separator and the heat transfer pipes.

5. The heat exchanger according to claim 2, wherein the distributor is provided below the gas-liquid separator, and wherein an outer shape of an upper part of the gas-liquid separator when being viewed along the first direction is a curved shape.

6. The refrigeration cycle apparatus according to claim 4, wherein the gas-liquid separator is arranged on a leeward side of the plurality of heat transfer pipes.

7. The refrigeration cycle apparatus according to claim 4, wherein the distributor is provided below the gas-liquid separator, and wherein an outer shape of an upper part of the gas-liquid separator when being viewed along the first direction is a curved shape.

8. The refrigeration cycle apparatus according to claim 6, wherein the distributor is provided below the gas-liquid separator, and wherein an outer shape of an upper part of the gas-liquid separator when being viewed along the first direction is a curved shape.

* * * * *